United States Patent [19]

Muhlethaler et al.

[11] 4,138,716

[45] Feb. 6, 1979

[54] LIGHTING FIXTURE ENCLOSURE

[75] Inventors: Richard V. Muhlethaler, Park Ridge; Richard J. Walls, Geneva, both of Ill.

[73] Assignee: Arrem Plastics Inc., Addison, Ill.

[21] Appl. No.: 799,552

[22] Filed: May 23, 1977

[51] Int. Cl.[2] ..... F21V 17/00

[52] U.S. Cl. ..... 362/375; 362/260; 362/267; 362/370

[58] Field of Search ..... 362/217–225, 362/260, 267, 362, 364, 365, 368, 373–375, 370

[56] References Cited

U.S. PATENT DOCUMENTS

| | | | |
|---|---|---|---|
| 2,309,792 | 2/1943 | Schepmoes | 362/220 |
| 2,643,328 | 6/1953 | Elmendorf | 362/224 |
| 2,797,312 | 6/1957 | Fletcher | 362/375 |
| 2,873,358 | 2/1959 | Dunker | 362/267 |
| 2,913,575 | 11/1959 | Lipscomb | 362/223 |
| 2,988,633 | 6/1961 | Rosenfield | 362/219 |
| 3,012,132 | 12/1961 | Rosenfield | 362/219 |
| 3,085,152 | 4/1963 | Schwartz et al. | 362/224 |
| 3,185,835 | 5/1965 | Müller et al. | 362/225 X |

FOREIGN PATENT DOCUMENTS

| | | | |
|---|---|---|---|
| 924899 | 5/1963 | United Kingdom | 362/217 |

*Primary Examiner*—Richard L. Moses

*Attorney, Agent, or Firm*—Wegner, Stellman, McCord, Wiles & Wood

[57] ABSTRACT

An elongated lighting enclosure for tubular light bulbs has a downwardly opening plastic housing within which a lighting fixture chassis and lamps are mounted. The housing has a top, sides and ends, the sides each having an inwardly opening channel with an inturned lower flange at its lower edge. A resilient gasket is seated in the inwardly opening channel and along the ends. An upwardly opening lens having a bottom, sides and ends and an outturned lip around its perimeter is received by the inwardly opening channels and engages the resilient gasket. The resilient gasket urges the lens against the housing to effect a positive pressure seal along the sides. A downwardly opening metal liner which generally conforms to the shape of the housing may be provided to accommodate the lighting fixture chassis.

23 Claims, 9 Drawing Figures

LIGHTING FIXTURE ENCLOSURE

BACKGROUND OF THE INVENTION

This invention relates to lighting fixtures and, more particularly, to a dust-tight moistureproof enclosure for lighting fixtures for use in areas of high abuse and subjected to dust, moisture and corrosive elements.

Many industrial environments require the use of special lighting fixtures. These fixtures must be able to withstand significant abuse. For example, in the food processing industry, it is not uncommon to spray selected working areas with soap and water at the end of the day. Since the entire work area is sprayed, the lighting fixtures must be properly sealed from moisture.

We have developed a plastic, inexpensive light fixture enclosure for use in areas of high abuse and subjected to dust, moisture and corrosive elements. The enclosure may be used with fluorescent lighting fixtures or other lighting fixtures such as low pressure sodium lamps.

SUMMARY OF THE INVENTION

A plastic enclosure may be secured to the ceiling, to support brackets, or to the conduit that provides electrical power to the lighting fixture within. The enclosure includes a housing and a lens. The housing opens downwardly and has an inturned lower flange on its lower edge. The plastic lens opens upwardly and has an outturned lip around its perimeter and rests upon the inturned lower flange of the housing. The angle of the outturned lip with respect to the lens and the angle of the lower flange with respect to the housing are selected such that the joint between the two tends to draw the lens outwardly and the housing inwardly. A resilient gasket seated in the channel of the housing is of sufficient thickness to prevent moisture from passing through the joint, and urges the outturned lip against the inturned lower flange to effect a positive pressure seal along the sides. Several different types of downwardly opening metal liners may be used within the housing, some of which advantageously retain the lighting fixture chassis in the event of destruction of the enclosure.

It is a feature of the present invention to provide a plastic lighting fixture enclosure with a snap-in lens which is moistureproof and dustproof.

Another feature of the present invention is to provide a lighting fixture enclosure which can withstand abuse such as bumping or jarring.

Yet another feature of the present invention is to provide a flange-type locking structure with a gasket so that the gasket applies a positive pressure seal to the lens, thereby enhancing the seal between the lens and the housing.

Another feature of the present invention is to provide a reliable latch between the housing and the lens which is not easily broken, worn out, and is an integral part of the housing.

Yet another feature of the present invention is to provide an enclosure which is adapted to easily receive the lighting fixture chassis.

Other features will become apparent when considering the specification in combination with the drawing in which:

DRAWING

DESCRIPTION OF PREFERRED EMBODIMENT

Figure 1:
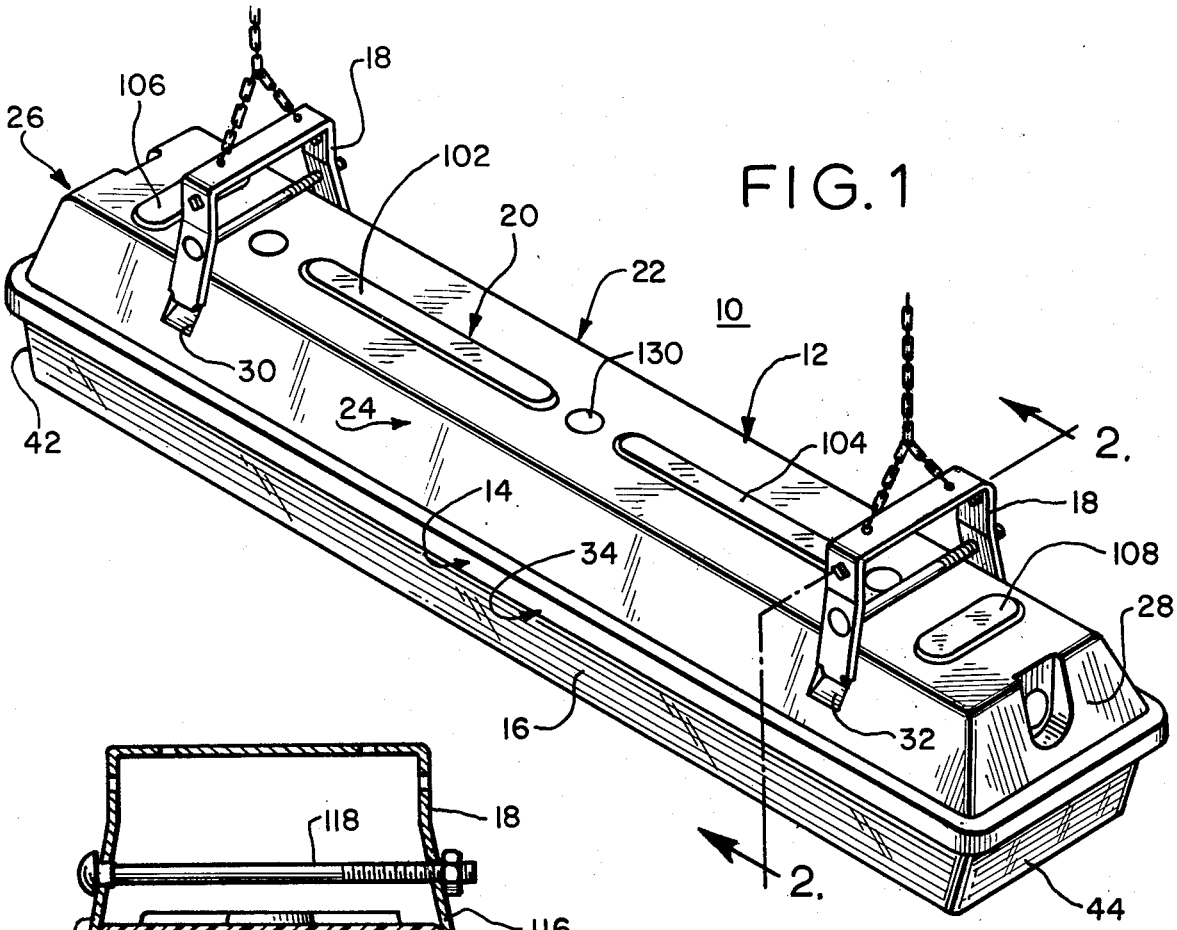
FIG. 1 is a perspective view of the general construction of the lighting enclosure.
Figure 2:
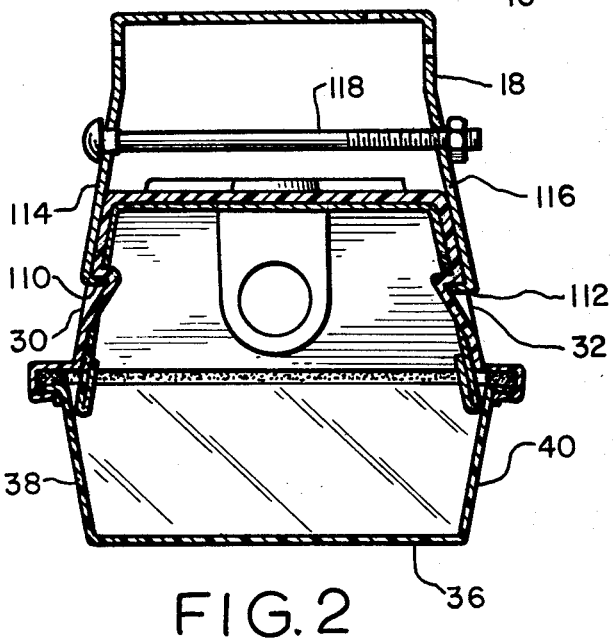
FIG. 2 is a cross-sectional view of the enclosure shown in FIG. 1.

Referring to FIGS. 1 and 2, lighting enclosure 10 is shown. Enclosure 10 includes a downwardly opening housing 12 having a channel 14 around its perimeter and lens 16. Brackets 18, connected to a flexible member such as a chain, suspend enclosure 10 from the ceiling (not shown). Transformers, starters, sockets and mounting plates, hereinafter referred to as a lighting fixture chassis, are contained within the housing 12. Elongated fluorescent bulbs or other electric discharge lamps may be mounted in the lighting fixture chassis. Lens 16 is secured to housing 12 at channel 14 to provide a moisture-tight, dust-free seal around the perimeter. The light enclosure 10 may be made in suitable lengths, as four feet or eight feet. Depending upon the material employed in the construction of the unit, the housing 12 and the len 16 may be highly resistant to breakage and damage. The sealed light enclosure 10 is washable and provides constant high efficiency lighting unobstructed by dust buildup within the housing or the lens.

Housing 12 is a one-piece plastic part having top 20, sides 22 and 24 and ends 26 and 28. Housing 12 may have two pairs of integral recessed undercuts 30 and 32 toward each end of the housing 12. The pairs of undercuts provide one means for suspending housing 12 from brackets 18 without the necessity of penetrating or drilling through the plastic housing. Inwardly opening integral channel 14 is provided around the perimeter of housing 12 and has an inturned lower flange 34 along sides 22 and 24 on which lens 16 rests.

Lens 16 is an upwardly opening one-piece translucent or transparent plastic part. The lens has a bottom 36, sides 38 and 40 and ends 42 and 44. Lip 46 extends outwardly from sides 38 and 40. The shape of lens 16 generally conforms to the shape of housing 12.

Figure 3:
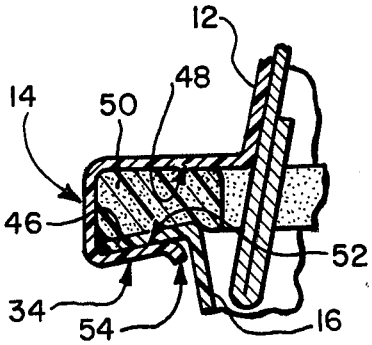
FIG. 3 depicts the construction of the joint between the housing, the resilient gasket and the lens along the sides of the housing.

Referring to FIG. 3, the joint between the sides 22 and 24 of housing 12 and the sides 38 and 40 of lens 16 will now be described. Channel 14 has an upper surface 48. Resilient gasket 50 is attached to upper surface 48 by an adhesive. Lower flange 34 is upturned at a small angle, as 15°, and is the lower wall of channel 14. Lip 46 rests on lower flange 34 and is downturned by an angle equal to the angle of the upturned lower flange 34, as 15° with respect to a horizontal line so that lip 46 rests evenly on the upper surface 52 of lower flange 34. The angle of the lip with respect to the lens and the angle of the lower flange with respect to the housing is selected such that the joint between the two tends to draw the lens sides 38 and 40 outwardly and the housing sides 22 and 24 inwardly. This relationship improves the effectiveness of the seal along the sides. Although the angle of the lip 46 with the sides 38 and 40 of lens 16 is exaggerated for the purpose of explanation, it has been found that the 15° angle with respect to a horizontal line is satisfactory to provide an acceptable joint. Also, resilient gasket 50 is of sufficient thickness to urge the lip 46 against the upper surface 52 of lower flange 34 and may be of any resilient gasketing material, as urethane foam. Moisture on housing 12 will tend to accumulate on downturned drip lip 54 and drip therefrom in lieu of penetrating the joint between the housing 12 and the lens 16.

Figure 4:
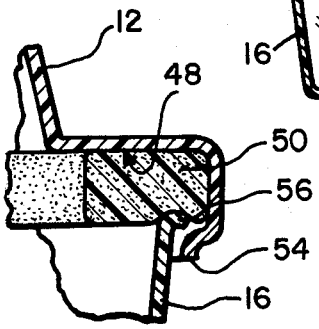
FIG. 4 depicts the construction of the joint between the housing, the resilient gasket and the lens at the ends of the housing.

Referring to FIG. 4, the joint between ends 26 and 28 of housing 12 and sides 38 and 40 of lens 16 will now be described. Resilient gasket 50 is secured to upper surface 48 in a manner similar to that shown in FIG. 3. The thickness of the gasket is sufficient to effect a seal between the housing 12 and the lens 16. Ends 42 and 44 of lens 16 have an outwardly extending lip 56 which is shorter than lip 46 (FIG. 3). The lower surface of channel 14 ends with drip lip 54 which extends downwardly and slightly below lip 56, but does not interfere with the insertion of lens 16 within housing 12.

Figures 5, 6, 7, 8:
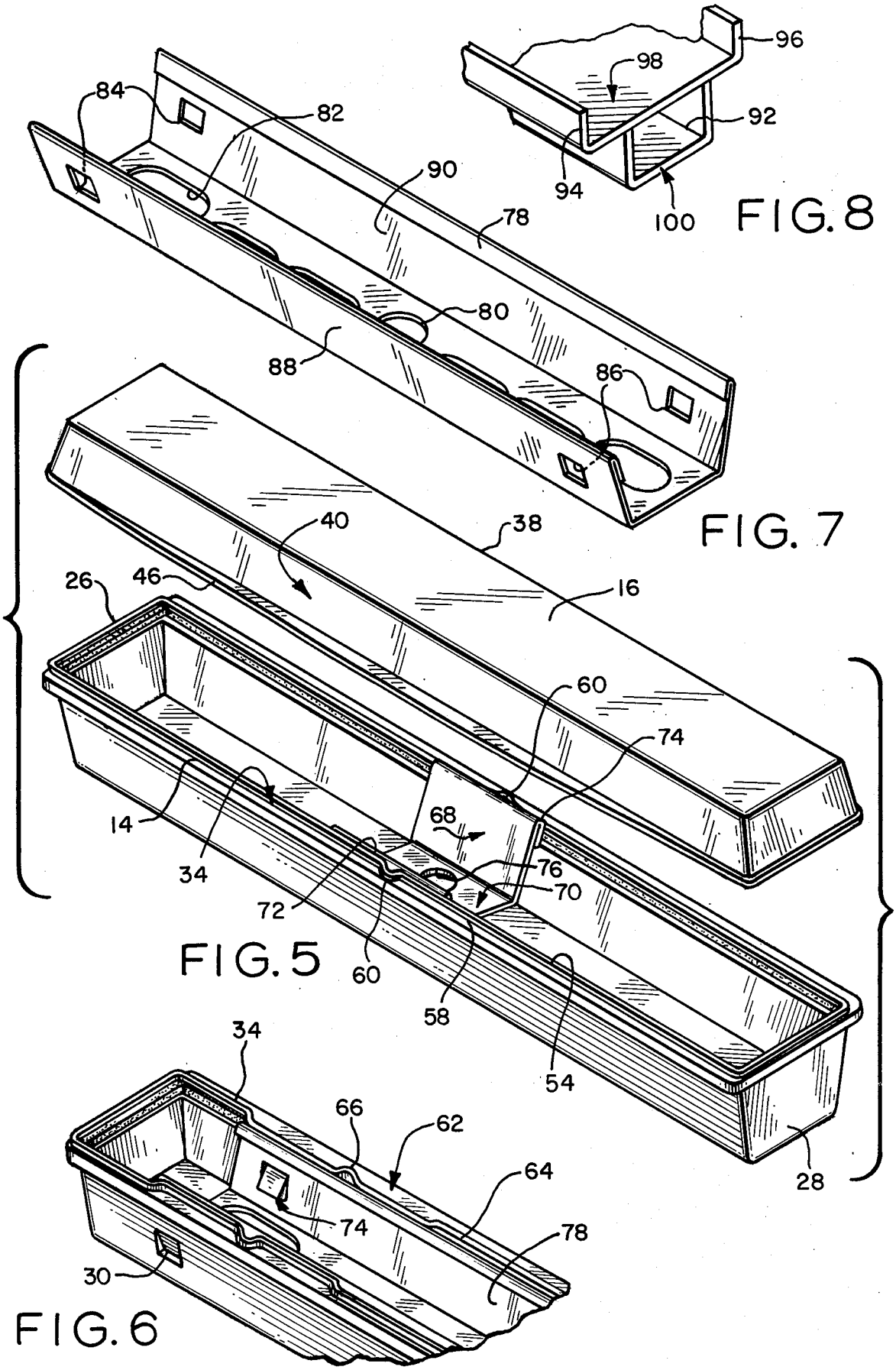
FIG. 5 is an exploded perspective view of a housing having a short metal liner therein with a continuous flange on each side of the housing.
FIG. 6 is a perspective view of the housing having an extended metal liner therein with a noncontinuous lower flange on each side.
FIG. 7 is a perspective view of an extended metal liner which may be disposed within the housing from end to end.
FIG. 8 is a perspective view of another type of liner that may be used within the housing.

Referring to FIGS. 5 and 6, lower flange 34 may be formed into two types of locking flange structures along the lower edge of channel 14 of housing 12. A continuous lower flange 58 spans the housing on each side from end to end to provide a continuous interlock with lip 46 of lens 16 in FIG. 5. In order to accommodate the continuous flange, lip 46 is tapered along sides 38 and 40 toward the ends. A recess 60, located toward the middle of housing 12 on each side 22 and 24 provides space for the insertion of the thumb to draw the sides outwardly to remove lens 16 from the housing 12 if desired. An alternate construction to a continuous flange 58 is shown in FIG. 6. Specifically, the lower flange 34 is not continuous, but occurs at intermittent distances along channel 14 as noncontinuous sections 62. Ridges 64, similar in construction to drip lip 54, span the distance between the noncontinuous sections 62. Recesses, as recess 66, provide for the insertion of the thumb to draw the flexible sides outwardly during removal of lens 16. In the event that a noncontinuous-type flange structure is employed, lip 46 need not be tapered along the sides toward the ends of lens 16 as shown by the dotted lines of FIG. 5.

It is desirable to provide housing 12 with a metal liner. Several different types of liners may be used, and the selection of a particular liner substantially depends upon the manner in which enclosure 10 is to be suspended from the ceiling. The liners provide a surface for mounting the lamp fixture chassis (not shown), reduce the bowing of the housing 12 and aid in the retention of lens 16 when the lens is bumped or jarred. The metal liners may be made of sheet metal and are suitably attached to the inside of the housing.

Figure 9:
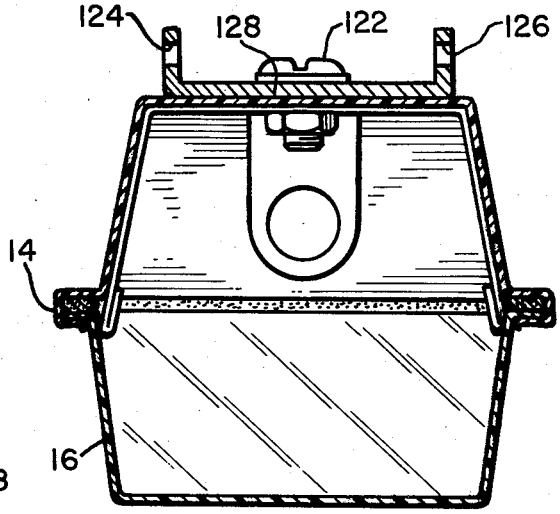
FIG. 9 is a cross-sectional view of a lighting enclosure similar to that of FIG. 1, but having a deeper housing and lens and another type of supporting bracket.

Short liner 68, as shown in FIG. 5, is usually disposed in a housing not having undercuts 30 and 32. The short liner may be located midway between ends 26 and 28. Base 70 has outwardly extending sides 72 and 74, the edges of which may be folded back upon themselves and extend in front of the opening of channel 14. Annular hole 76 may be provided in short liner 68 to accommodate electrical wiring if desired. Generally, when a short liner is used, the bracket structure as shown in FIG. 9 is employed to suspend enclosure 10 from the ceiling, as will be explained in greater detail below.

Extended liner 78, shown in FIG. 7, is usually disposed in a housing having undercuts 30 and 32. The extended liner may be disposed within the housing from end to end and provided with openings 80 and 82 to accommodate electrical wiring if desired. Also, extended liner 78 has two pairs of generally rectangular slots 84 and 86 along its sides 88 and 90. The pairs of slots accommodate the inward protrusions resulting from integral recessed undercuts 30 and 32, as best seen in FIG. 6. Generally, when extended liner 68 is used, the bracket structure of FIGS. 1 and 2 is employed to suspend the enclosure from the ceiling.

A third type of metal liner assembly is shown in FIG. 8. The assembly accommodates portions of the lamp chassis within cavity 92. Legs 94 and 96 extend generally at right angles from mounting plate 98. When in place, legs 94 and 96 extend in front of channel 14 to retain lens 16 therein if the lens is bumped or jarred. The liner is attached to the housing 12 at surface 100.

Enclosure 10 may be suspended from the ceiling in various ways. It may be held in position by the conduit which supplies power to the fixture within, or the housing 12 may be directly secured to the ceiling by an adhesive applied to attachment surfaces 102 and 104, as shown in FIG. 1. Leveling bars 106 and 108 aid in the leveling of the enclosure 10 if the housing is mounted on an uneven surface. Also, the enclosure 10 may be suspended from the ceiling by the use of brackets as shown in FIGS. 1 and 2 or brackets shown in FIG. 9.

As seen in FIGS. 1 and 2, lips 110 and 112 extending inwardly from arms 114 and 116 of bracket 18 are held within undercuts 30 and 32 by nut and bolt assembly 118. This construction permits the enclosure to be "snapped in" the bracket 18 after the bracket has been mounted on the ceiling or suspended from a flexible member. In the event that housing 12 is provided with an extended liner, an additional advantage is realized. Specifically, lips 110 and 112 extend inwardly a sufficient distance to retain liner 78 if plastic 12 is destroyed, as during fire.

Referring to FIG. 9, bracket 120 is secured to the housing 12 by nut and bolt assembly 122. Bracket 120 is shown with a deeper housing and a deeper lens as compared to the housing and lens shown in FIG. 2. Bracket 120 may be used with either enclosure. Bracket 120 may be suspended by a flexible member connected through holes 124 and 126. Also, washer 128 may be provided with the nut and bolt assembly 122 to prevent moisture from entering the enclosure.

It will be apparent that a variety of different combinations of liners and housings may be employed to satisfy many lighting requirements. For example, a shallow housing and lens may be used to accommodate lower intensity fluorescent bulbs, whereas a deeper housing and deeper lens is used to accommodate lamps requiring larger electrical components. Also, the housing 12 may be provided with a plurality of electrical knockouts, as knockout 130, to accommodate electrical connections to and from the assembly.

Finally, in an effort to minimize packaging costs, the housing may be inverted and placed within the lens during shipping of the product.

We claim:

1. A lighting enclosure comprising:

a plastic housing within which a lighting fixture chassis may be mounted, the housing having downwardly projecting sides, each side having an inwardly opening channel with an inturned lower flange on its lower edge;

a metal lining means generally conforming to the shape of the housing and disposed within the housing;

a resilient gasket seated in the inwardly opening channel; and an upwardly opening lens having inwardly projecting sides, the shape of the lens generally conforming to that of the housing, each of the upwardly projecting sides having out-turned lips, the lips received in the inwardly opening channel and supported on the inturned lower flange, said lens in engagement with the resilient gasket.

2. An elongated lighting enclosure comprising:

a downwardly opening plastic housing within which a fluorescent unit may be mounted, the housing having first and second sides and first and second ends, the first and second sides having an inwardly opening channel with an inturned lower flange on its lower edge;

a resilient gasket seated in the inwardly opening channel; and an upwardly opening lens having a bottom, first and second ends and first and second sides, each of the first and second sides having outturned lips, said lips received in the inwardly opening channel and supported on the inturned lower flange wherein the outturned lips of the lens are angled downwardly from the first and second sides thereof and the lower flange of the housing angles upwardly so that the first and second sides of the housing and the first and second sides of the lens are drawn together, and said lens is in engagement with the resilient gasket.

3. The enclosure of claim 2 including:

a metal lining means generally conforming to the shape of the housing and disposed within the housing.

4. The enclosure of claim 2 wherein the resilient gasket is disposed on an upper side of the channel such that the gasket engages an upper side of the outturned lips of the lens.

5. The enclosure of claim 2 wherein the lower flange makes a 15° angle with respect to a horizontal line, and the outturned lip of the lens lies flat against the upturned lower flange.

6. The enclosure of claim 5 wherein the resilient gasket is secured to the upper surface of the channel.

7. The enclosure of claim 2 wherein the resilient gasket is of sufficient thickness to urge the outturned lips against the inturned lower flange to provide a uniform seal along the sides.

8. The lighting enclosure of claim 1 wherein the metal lining means is a single metal liner which spans the length of the housing from end to end.

9. The lighting enclosure of claim 1 wherein the metal lining means is a plurality of spaced-apart short metal segments disposed within the housing.

10. An enclosure for a fluorescent unit comprising:

a downwardly opening housing within which a lighting unit may be mounted, the housing having downwardly extending sides;

inwardly formed recess means on the outer surface of the housing, said recess means adapted to receive a bracket, said inwardly formed recess means forming corresponding inward protrusions on the inner surface of the housing;

metal lining means generally conforming to the shape of the housing disposed within the housing, the metal lining means having slots for receiving the inward protrusions on the inner surface of the housing; and bracket means received by an extending inwardly into the recess means such that the bracket means supports the lighting fixture by the housing and if the housing is damaged or melted, as a result of fire or the like, the bracket means extending through the slots supports the lighting fixture by the metal lining means.

11. An elongated enclosure for a tubular fluorescent or other electric discharge unit comprising:

a downwardly opening plastic housing within which a unit may be mounted, the housing having a top, first and second sides and first and second ends, the first and second sides each having an inwardly opening channel with an inturned lower flange on its lower edge;

a resilient gasket seated in the inwardly opening channels and along the first and second ends;

an upwardly opening lens having a bottom, first and second ends and first and second sides, each of the first and second sides having outturned lips, the lips received in the inwardly opening channels and in engagement with the resilient gasket; and downwardly opening metal liner means generally conforming to the shape of the housing and disposed within the housing.

12. The enclosure of claim 11 wherein said metal lining means is a single metal liner which spans the length of the housing from end to end, and the sides thereof extend downwardly and in front of the inwardly opening channels, said metal liner retaining the lens in the channels in the event that the lens is bumped or jarred.

13. An elongated lighting enclosure comprising:

a downwardly opening plastic housing within which a fluorescent unit may be mounted, the housing having first and second sides and first and second ends, the first and second sides each having an inwardly opening channel with an inturned lower flange on its lower edge;

a resilient gasket seated in the inwardly opening channel;

an upwardly opening lens having a bottom, first and second ends and first and second sides, each of the first and second sides having outturned lips, said lips received in the inwardly opening channel and supported on the inturned lower flange, said lens in engagement with the resilient gasket; and a metal lining means generally conforming to the shape of the housing and disposed within the housing.

14. The enclosure of claim 13 wherein the metal lining means extends downwardly and in front of the inwardly opening channel to aid in the retention of the lens in the event that the lens is bumped or jarred.

15. The enclosure of claim 13 wherein the metal lining means is a single metal liner which spans the length of the housing from end to end.

16. The enclosure of claim 13 wherein the metal lining means is a plurality of spaced-apart short metal liner segments disposed within the housing.

17. An elongated lighting enclosure comprising:

a downwardly opening plastic housing within which a fluorescent unit may be mounted, the housing having first and second sides and first and second ends, the first and second sides each having an inwardly opening channel with an inturned lower flange on its lower edge;

a resilient gasket seated in the inwardly opening channel; and an upwardly opening lens having a bottom, first and second ends and first and second sides, each of the first and second sides having outturned lips, said lips received in the inwardly opening channel and supported on the inturned lower flange wherein the inturned lower flange is continuous along each side of the housing from end to end and the outturned lip on each side of the lens is tapered along each of the first and second sides toward the end, said lens in engagement with the resilient gasket.

18. An elongated lighting enclosure comprising:

a downwardly opening plastic housing within which a fluorescent unit may be mounted, the housing having first and second sides and first and second ends, the first and second sides each having an inwardly opening channel with an inturned lower flange on its lower edge wherein the inturned lower flange is noncontinuous along each side of the housing from end to end, the noncontinuity defined by ridges in the lower flange;

a resilient gasket seated in the inwardly opening channel; and an upwardly opening lens having a bottom, first and second ends and first and second sides, each of the first and second sides having outturned lips, said lips received in the inwardly opening channel and supported on the inturned lower flange, said lens in engagement with the resilient gasket.

19. An elongated lighting enclosure comprising:

a downwardly opening plastic housing within which a fluorescent unit may be mounted, the housing having first and second sides and first and second ends, the first and second sides each having an inwardly opening channel with an inturned lower flange on its lower edge wherein the housing has at least a pair of inwardly formed molded recesses on the outer surface of the first and second sides thereof, each of said pair of inwardly formed molded recesses adapted to receive a hanger bracket;

a resilient gasket seated in the inwardly opening channel; and an upwardly opening lens having a bottom, first and second ends and first and second sides, each of the first and second sides having outturned lips, said lips received in the inwardly opening channel and supported on the inturned lower flange, said lens in engagement with the resilient gasket.

20. The enclosure of claim 19 wherein the housing has at least a pair of inwardly formed molded recesses on the outer surface thereof, each of said pair of inwardly formed molded recesses corresponding to a pair of inward protrusions on the inner surface of the housing, and slots within the metal lining means for receiving the inward protrusions on the inner surface of the housing.

21. The enclosure of claim 19 wherein the hanger is a downwardly opening bracket having first and second sides and an inwardly extending lip on each side, said lips received in the pair of inwardly formed molded recesses.

22. The enclosure of claim 19 wherein said hanger bracket further includes:

means for drawing the sides of the bracket into engagement with the pair of inwardly formed molded recesses without penetrating the housing.

23. A lighting enclosure comprising:

a housing within which a lighting fixture chassis may be mounted, the housing having downwardly projecting sides, each side having an inwardly opening channel with an inturned lower flange on its lower edge;

a resilient gasket seated in the inwardly opening channel;

an upwardly opening lens having upwardly projecting sides, the shape of the lens generally conforming to that of the housing, each of the upwardly projecting sides having outturned lips, the lips received in the inwardly opening channel and supported on the inturned lower flange, said lens in engagement with the resilient gasket; and a downwardly extending drip lip on the inturned lower flange.

* * * * *